United States Patent [19]

Chateau

[11] Patent Number: 4,961,578

[45] Date of Patent: Oct. 9, 1990

[54] MACHINE FOR DRAWING OF LOTTERY BALLS

[76] Inventor: Clotaire R. G. Chateau, 9, allee des Sapins, 94 420 Le Plessis Trevise, France

[21] Appl. No.: 367,040

[22] Filed: Jun. 16, 1989

[30] Foreign Application Priority Data

Jun. 24, 1988 [FR] France ..... 88 08493
May 3, 1989 [FR] France ..... 89 05866

[51] Int. Cl.[5] ..... A63F 9/00

[52] U.S. Cl. ..... 273/144 R; 273/144 A; 273/144 B

[58] Field of Search ..... 273/144 R, 144 A, 144 B

[56] References Cited

U.S. PATENT DOCUMENTS 2,385,980 10/1945 Fostas ..... 273/144 A X
4,508,346 4/1985 Salvucci .

FOREIGN PATENT DOCUMENTS 0271365 6/1988 European Pat. Off. .
WO84/00115 1/1984 PCT Int'l Appl. ..... 273/144 B
791383 12/1980 U.S.S.R. ..... 273/144 A
1407930 10/1975 United Kingdom .

OTHER PUBLICATIONS

Copy of French Search Report.

*Primary Examiner*—Edward M. Coven
*Assistant Examiner*—Raleigh W. Chiu
*Attorney, Agent, or Firm*—Sandler, Greenblum & Bernstein

[57] ABSTRACT

A machine for the random drawing of balls being agitated by aa current of air. The machine includes a transparent receptacle in which the balls are placed, an annular space placed below and communicating with the receptacle, and a plurality of orifices defined by flaps positioned within the annular space. The flaps are capable of at least partially sealing the annular space.

9 Claims, 4 Drawing Sheets

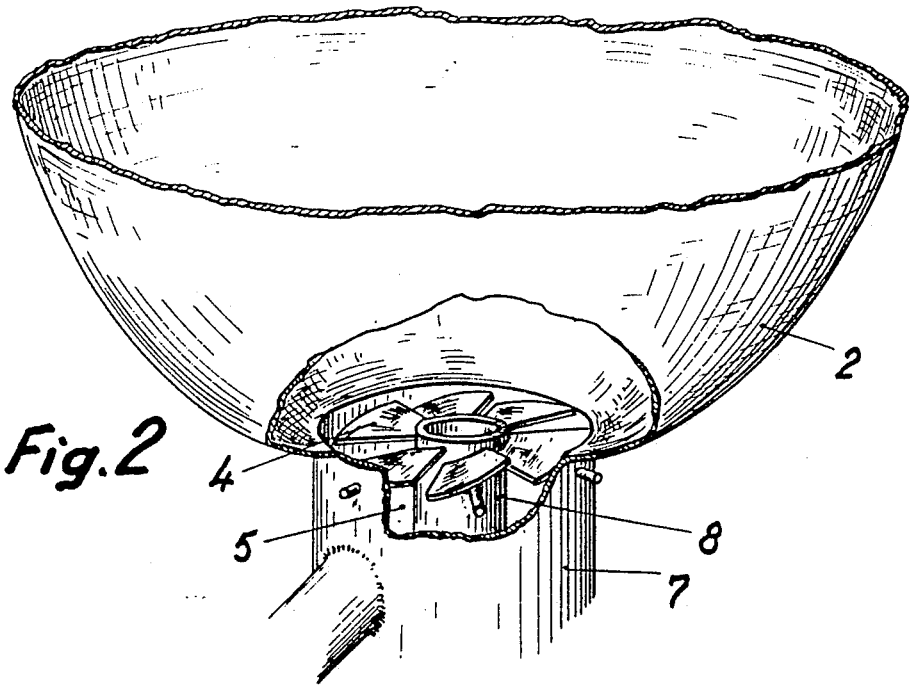
Fig. 2
Fig. 3
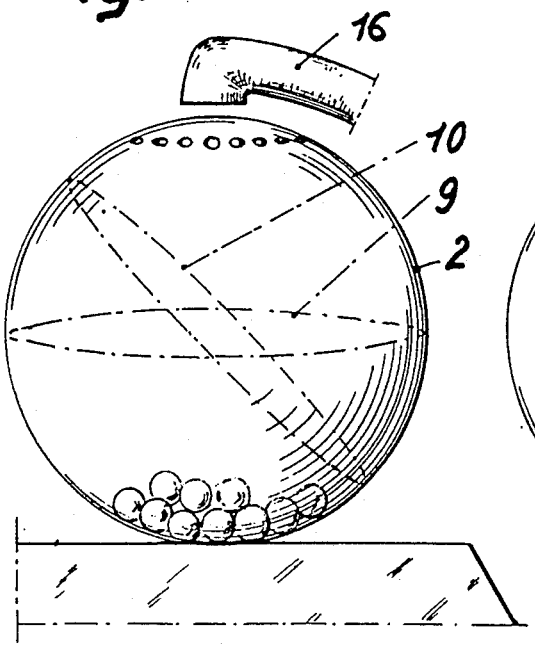
Fig. 4
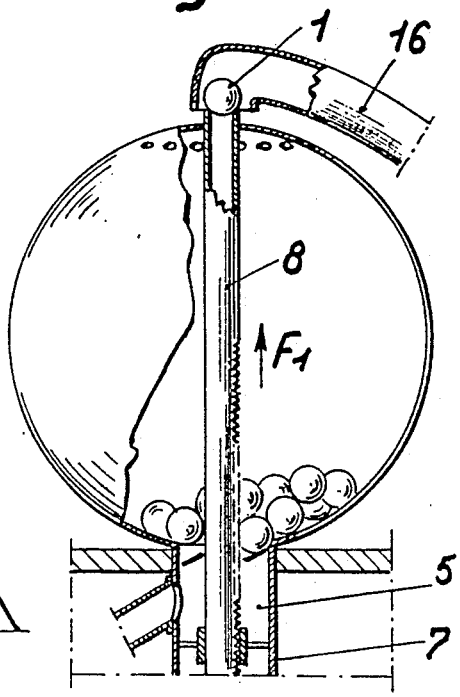

MACHINE FOR DRAWING OF LOTTERY BALLS

FIELD OF THE INVENTION

The present invention relates to a machine for the random drawing of balls, of the type used, for example, for the selection of lottery numbers.

BACKGROUND OF THE INVENTION

These machines comprise small balls, marked with a number, placed in a receptacle comprising means to agitate them and extract them one by one, in a random fashion.

These machines must fulfill three criteria.

In the first place, they must be reliable and the drawing must be perfectly random.

In the second place, as the drawings are public, numbers on the balls must be readily visible.

Finally, for reasons connected to the psychology of the participants at the lottery, it is essential that each player who attends the drawing have no doubts about the origin of the ball extracted. In other words, as soon as the ball is caught, in a random fashion, by the extraction mechanism of the machine, it must still remain perfectly visible to the spectators.

The existing machines do not make it possible to fulfill these three criteria in a satisfactory fashion.

The machine of the invention which overcomes these disadvantages is of the type in which the balls are agitated by a blower and the balls are placed in a spherical and transparent receptacle, comprising a plurality of orifices for the escape of pulsed air.

The jets of air thus produced are directed obliquely with respect to the vertical and to the horizontal of a point.

According to another embodiment, the ball can enter a tube which has an inner diameter slightly greater than that of the balls, and is evacuated at an orifice provided on the lower part of the tube, the means being provided so that the introduction of a ball in the tube is one at a time, and occurs at the instant desired by the user and, only at this instant.

Other characteristics will become clear from the description which follows, by referring to the annexed drawings by way of example only.

BRIEF DESCRIPTION OF THE DRAWINGS

FIG. 2 is an enlarged partial view in perspective showing, particularly, escape orifice's for the pulsed air.

FIGS. 3 and 4 are partial views showing the machine in operation and the extraction of a ball respectively;

Figure 1:
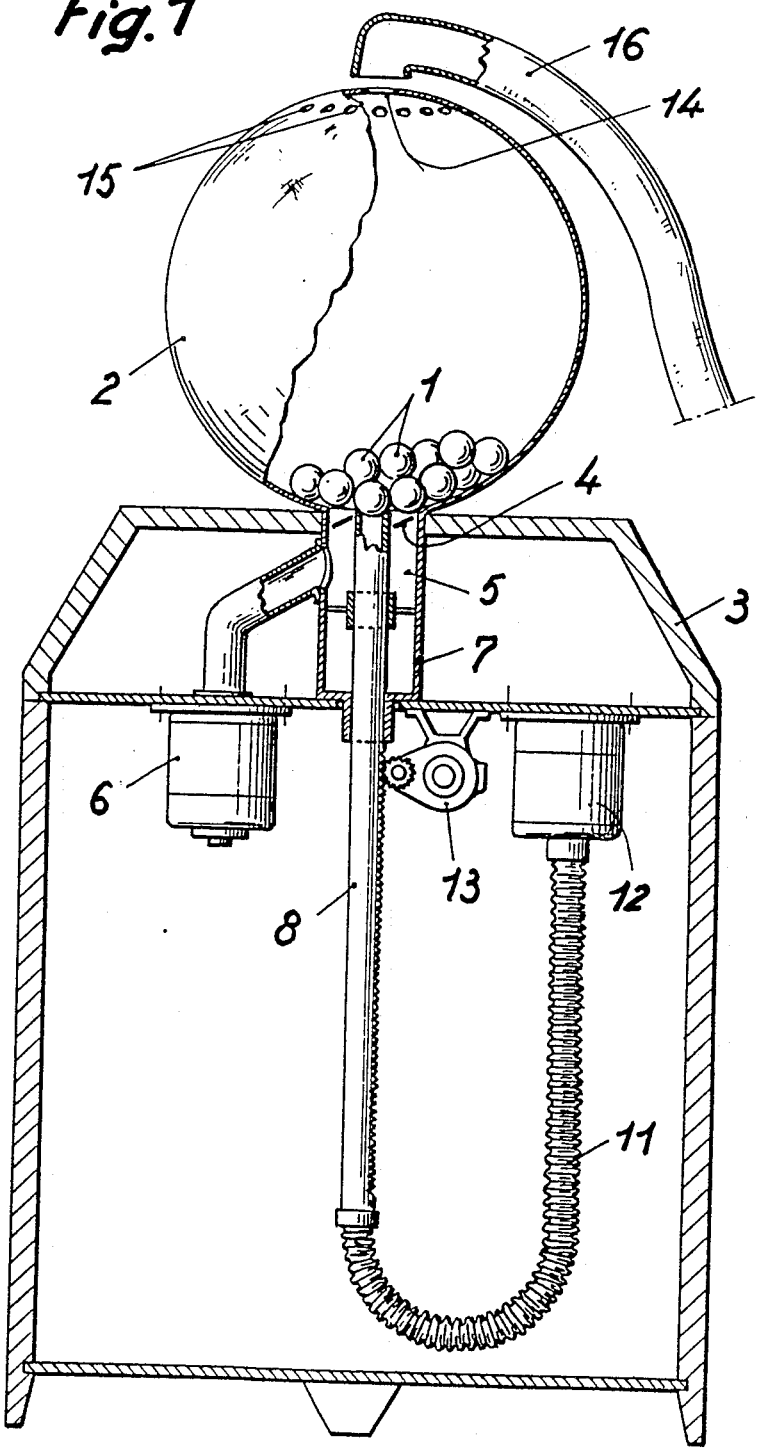
FIG. 1 is a vertical sectional view of a machine conforming to the invention.

By referring to the drawings, it can be seen that the balls 1 are placed in a receptacle 2 which is a hollow and transparent sphere, resting on a support 3.

The lower part of the sphere 2 communicates, by means of flaps 4, with an annular space 5 in which pulsed air is sent by means of a compressor 6 lodged in the support 3.

The annular space 5 is defined by a tubular casing 7 and by a central tube 8 whose use will be described below. The flaps 4 are each journalled around axes extending radially with respect to the space 5. The control of the inclination of the previously cited flaps not posing any particular probelm, the latter has not been shown; it can be manual or remote-controlled.

When the flaps 4 are open and all inclined in the same direction and the pulsed air is sent the balls 1 turn in the sphere 2 and are stirred up. It can be seen then that all of the balls are placed along a diametric ring, as shown in 9 of FIG. 3.

It can also be observed that by closing certain adjacent flaps, one could place the balls 1 along a ring such as 10, as shown in FIG. 3.

In the two cases, the balls forming the rings turn, and thus there is obtained an important scenic effect which is heightened if the balls have different colors.

Experience has shown that if the number of balls is greater than that admissible to form a diametric ring, the balls are placed spontaneously along two parallel rings.

Finally, it has been observed that if one reverses the inclination of one of the flaps, the ring formed by the balls tips and tends to be placed in a vertical plane.

Tube 8 is connected by a flexible pipe II to an aspirator 12 able to create a sudden depression in said tube. At the instant when the drawing of a ball must be done, one interrupts the sending of the air and, at this moment, the ring "explodes", i.e. all the balls which were positioned along this ring move in a perfectly unpredictable fashion in the sphere.

According to the invention, one can take advantage of this transitory phase to "capture" a ball and, to that effect, there is created a sudden depression in the tube 8 which has the effect of sucking up the ball which passes close to the upper orifice of the tube 8.

The ball captured is firmly held by the depression and the shocks caused by the other balls have no effect.

At this moment, there is activated, for example, a back-geared motor 13 which causes the axial displacement, along arrow $F_1$ of the tube 8. The latter pushes the captured ball and attracts it from the sphere, the latter having to this effect, at its upper part, an opening 14 (FIG. 1).

The opening 14 necessarily having the most reduced section possible, there are provided, on the upper part of the sphere, small orifices 15 so that the flow of air is not checked.

As a safety measure, the opening 14 can be partially sealed by flexible tongues (not shown) opposing the untimely ejection of a ball, but retracting under the action of tube 8.

Naturally, the machine can be completed by a transparent chute such as 16, making it possible to evacuate the ball drawn for example, by means of a blower not shown or another device.

Figure 5:
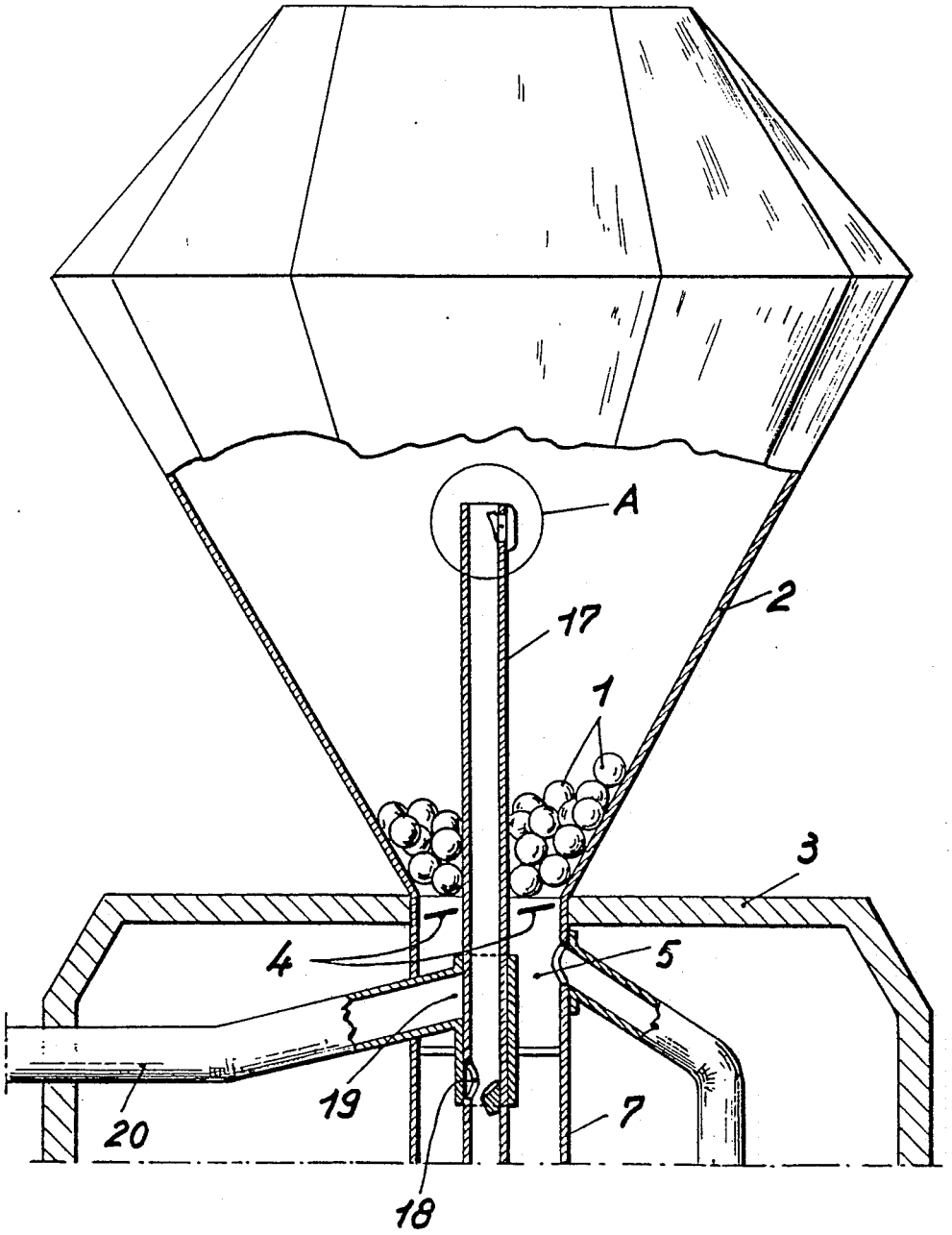
FIG. 5 is a partial view, in section, showing another embodiment of the machine conforming to the invention.

According to another embodiment, it can be seen that the balls are placed in a receptacle 2, which is transparent, resting on a support 3 (FIG. 5).

The lower part of the receptacle 2 communicates by means of flaps 4 with an annular space 5, defined by a tubular casing 7 and by a central tube 17, axially movable and whose internal diameter is slightly greater than that of the balls 1.

The tube 17 has, towards its lower part, a lateral orifice 18 capable of mating with the inlet orifice 19 of a fixed pipe 20 making it possible to evacuate the balls.

The essential problems to be overcome include:

preventing the balls from penetrating inopportunely in the tube 17;

holding, at the instant determined by the user, one ball at a time in the upper part of the tube;

evacuating this ball.

Figure 6:
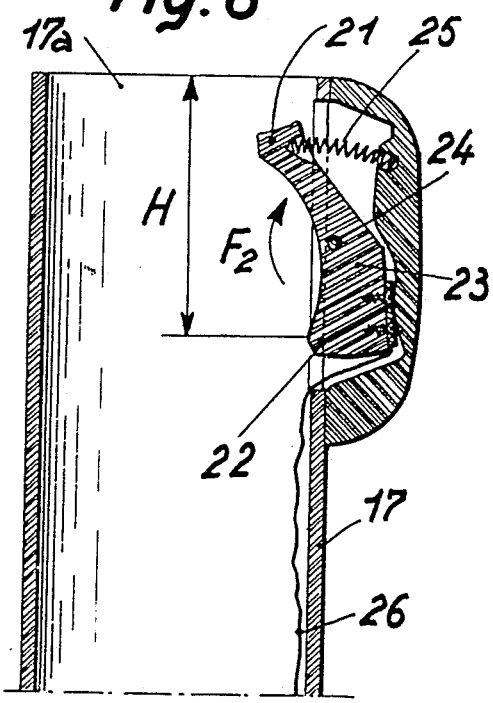
FIG. 6 is an enlarged view, of detail A of FIG. 5.
Figure 7:
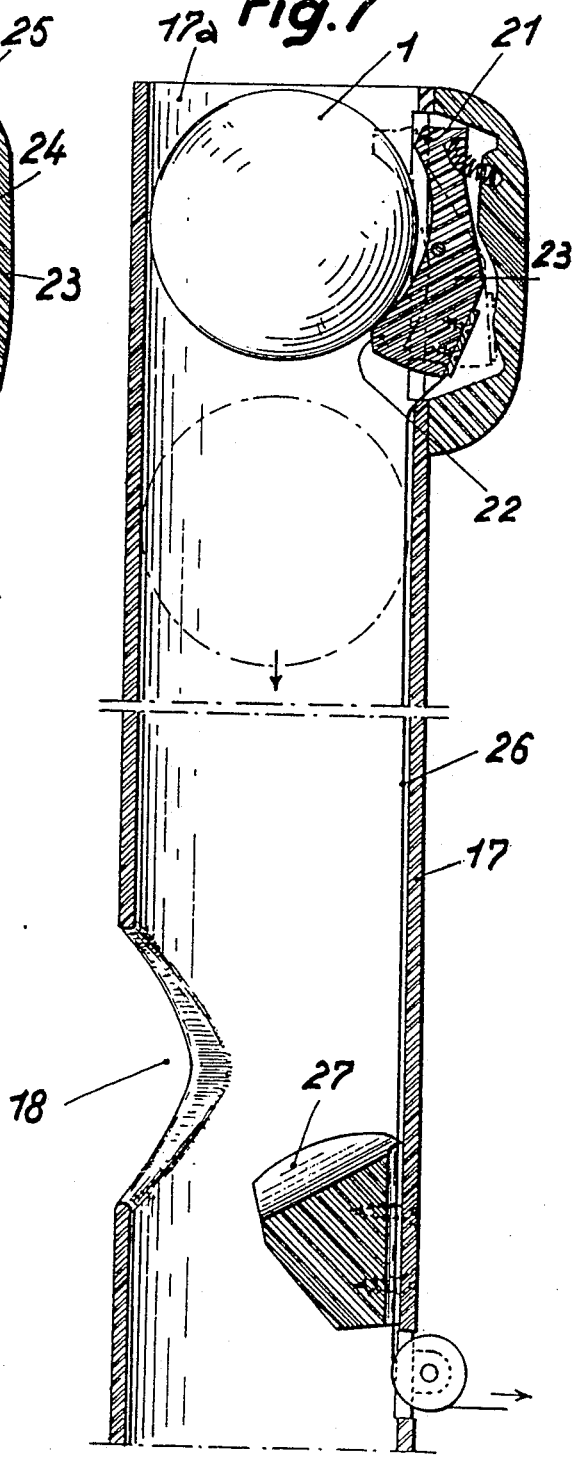
FIG. 7 is a view similar to that of 6, showing the lower part of a movable tube.

This result is obtained by providing, in the upper part of the tube, two retractable stops 21 and 22 capable of projecting within the tube 17, as seen in FIGS. 6 and 7.

The stop 21 is situated nearest the inlet orifice 17*a* of the tube and it prevents the penetration of the balls in the tube and even the holding of a ball at the end of said tube.

The stop 22 is situated at a distance H from the orifice 17*a* which is such that when a ball is held by said stop, the top of said ball is substantially flush with the end of the tube and prevents the penetration of another ball and even, its holding in place (FIG. 7).

When the balls are agitated in the receptacle 2, the stop 21 projects in the tube.

To capture a ball, there is created a strong suction in the tube 17 to draw a ball facing the orifice 17*a* and, successively, but in a very brief lapse of time, one retracts the stop 21 and one projects stop 22.

The ball captured is thus quite visible at the end of the tube which is made of a transparent material.

To evacuate the ball, the stop 22 is retracted, simultaneously, stop 21 s projected, and the ball falls and passes out of the tube through orifice 18.

According to an embodiment of the machine, the orifice 18 does not meet with that 19 of the pipe 20. Thus, as shown in the drawings, it is necessary to elevate the tube to make the two orifices meet, but the reverse is likewise possible.

According to an embodiment, the stops 21 and 22 form the ends of a lever 23, journalled, substantially in its middle, on an axis 24, said lever being constantly subject to the action of a spring 25 which forces the stop 21 to project in the tube 17.

When, by an exterior action, one forces the lever 23 to pivot along arrow F2 one determines simultaneously the retraction of the stop 21 and the exit of 22.

Such an action can be achieved, for example, by means of a cable 26, fixed on the lower part of the lever 23, in a point which is carried towards the exterior with respect to the axis 24. Tensioning of the cable can be achieved by any known means.

It is apparent that in the device a deflector stop 27 can direct the ball to be evacuated towards the orifice 18.

Of course, the present invention is not limited to the embodiments described and shown but extends, on the contrary, to all alternative forms and dimensions.

I claim:

1. An apparatus for the random selection of balls being agitated by a current or air, said apparatus comprising a transparent receptacle adapted to receive and contain said balls, an annular space positioned beneath and communicating with said receptacle, and a plurality of orifices disposed within said annular space and immediately below said receptacle, said orifices being defined by flaps which are capable of at least partially sealing said annular space.

2. The apparatus as defined by claim 1, wherein said flaps are selectively adjustable to a desired inclination.

3. The apparatus as defined by claim 1, wherein said annular space comprises a fixed, external tubular casing surrounding and spaced from a central tube, said central tube being axially movable between a lower position wherein the top of said central tube is level with the bottom of said receptacle and an upper position wherein the top of said central tube is above the bottom of said receptacle, said central tube having an internal diameter less than the diameter of said balls and being connected to a vacuum source which may be used to create a suction within said central tube.

4. The apparatus as defined by claim 3, wherein said receptacle further comprises an orifice in its upper part positioned and adapted to accommodate said central tube, and wherein said central tube has an upper position in which the top of said central tube is at least level with the top of said receptacle and disposed within said orifice.

5. The apparatus as defined by claim 4, wherein said central tube has an upper position in which the top of said central tube projects above the top of said receptacle and is disposed within said orifice.

6. An apparatus for the random selection of balls being agitated by a current of air, said apparatus comprising a transparent receptacle adapted to receive and contain said balls, an annular space positioned beneath and communicating with said receptacle, and a plurality of orifices disposed within said annular space and immediately below said receptacle, said orifices being defined by flaps which are capable of at least partially sealing said annular space, further wherein said annular space comprises a tube which is axially movable, said tube being connected to a vacuum source which may be sued to create a suction within said central tube, said tube having an internal diameter slightly greater than the diameter of said balls, said tube further comprising an upper part comprising means for preventing untimely introduction of a ball, means for holding a captured ball towards the end of said tube, and means for evacuating said captured ball.

7. The apparatus as defined by claim 5, further wherein said tube comprises a lateral orifice positioned towards the lower part of said tube which can mate with an inlet orifice of a fixed pipe.

8. The apparatus as defined by claim 5, wherein said tube comprises two retractable stops toward its upper end, the upper stop being situated closest to the inlet orifice of said tube, and the lower stop being situated at a distance H from the top of said tube such that the top of a ball being held by said lower stop is substantially flush with said inlet orifice.

9. The apparatus as defined by claim 8, wherein said upper and lower stops form the ends of a pivoting lever, said pivoting lever being continually subjected to the action of a spring which pushes said upper stop in said tube, said apparatus further comprising means for pivoting said pivoting lever against the action exerted by said spring.

* * * * *